US006752682B1

(12) United States Patent
Ferrell

(10) Patent No.: US 6,752,682 B1
(45) Date of Patent: Jun. 22, 2004

(54) HAND-LAUNCHED TOY ROCKET

(76) Inventor: Conrad M. Ferrell, P.O. Box 418, Burson, CA (US) 95225

( * ) Notice: Subject to any disclaimer, the term of this patent is extended or adjusted under 35 U.S.C. 154(b) by 0 days.

(21) Appl. No.: 10/402,431

(22) Filed: Mar. 28, 2003

(51) Int. Cl.[7] ..... A63H 27/00; F41B 15/00; F41F 1/00; F41F 7/00

(52) U.S. Cl. ..... 446/230; 446/231; 124/26; 124/16; 124/37; 473/576

(58) Field of Search ..... 446/230, 231, 446/63, 211, 212, 486, 52; 124/26, 37, 16; 473/575, 576, 614

(56) References Cited

U.S. PATENT DOCUMENTS

| | | | | | |
|---|---|---|---|---|---|
| 2,751,711 | A | * | 6/1956 | Greenwood | 446/399 |
| 3,108,395 | A | * | 10/1963 | Goldfarb | 446/311 |
| 3,191,342 | A | * | 6/1965 | Chalmers | 446/231 |
| 3,292,302 | A | * | 12/1966 | Estes et al. | 446/212 |
| 3,793,765 | A | * | 2/1974 | Schatz | 446/231 |
| 4,038,776 | A | * | 8/1977 | Filipeli | 446/52 |

* cited by examiner

*Primary Examiner*—Jacob K. Ackun
*Assistant Examiner*—Bena B. Miller

(57) ABSTRACT

A cylindrical toy rocket that measures at least 8-inches long and 2½ inches in diameter. The rocket has a weighted rubber nose cone that is mounted on an inner slide tube that fits inside the rocket's main body tube in contact with a compression spring. At least three guide fins are attached to the outside bottom of the rocket's main body tube. The rocket is launched by means of an attached tether and gripping handle. In use, the handle is gripped in the hand of the player and swung in a vertical circular motion starting in an upward direction. The rocket is then released such that it is catapulted upward into the sky along an initial flight path. When the rocket reaches its apex and starts a descent, the heavier nose cone will assume a downward position. Upon impact with the ground, the nose cone and inner sliding tube are forced into the main tube body of the rocket, thereby compressing and storing potential energy in the spring. The spring then releases this stored energy, catapulting the rocket back into the air along a secondary flight path. The hand-launched toy rocket is a new toy that can provide outdoor entertainment for boys and girls. There is no operational cost associated with the toy since it is manually operated. The toy will provide exercise, imagination, and all-around fun for any player.

20 Claims, 3 Drawing Sheets

HAND-LAUNCHED TOY ROCKET

BACKGROUND OF THE INVENTION

1. Field of the Invention

The present invention relates to a hand-launched rocket for use as a child's toy. The hand-launched toy rocket has particular utility in entertaining a child by self-launching for a second flight upon striking the ground from the initial flight.

2. Description of the Prior Art

Children have long enjoyed toys that relate to flight in general and rockets in particular. Powered model rockets, which are very small versions of real rockets, are available in all sizes, shapes, and cost. Since these are usually considered too dangerous for small children to play with without adult supervision, simpler and safer hand-launched rockets, which a child can launch for short flights, are popular.

The use of hand-launched toy rockets is known in the prior art. For example, U.S. Pat. No. 3,793,765 to Schatz discloses a bouncing toy rocket that is similar in function to the present invention. This toy rocket is thrown on to the ground where a spring-loaded ball at the exhaust end of the rocket is used to launch (bounce) the rocket for a short flight. However, the Schartz '765 patent discloses a rocket that is different in structure from the present invention and is not catapulted into the air for an initial flight, nor does it self-launch for a second flight upon striking the ground from the initial flight.

U.S. Pat. No. 3,121,292 to Butler et al. discloses one and two-stage compressed air launched toy rockets. However, the Butler '292 patent is different in structure from the present invention and does not disclose a hand catapulted rocket that provides a self-launched second flight upon striking the ground.

Also, U.S. Pat. No. 3,299,564 to Quercetti discloses launching pad and flying toy combination. However, the Quercetti '564 patent is different in structure from the present invention and does not disclose a hand catapulted rocket that provides a self-launched second flight upon striking the ground.

Similarly, U.S. Pat. No. 6,048,250 to Hudson discloses a toy dart that is hand thrown and has a bulbous head portion filled with air or liquid, which is used to produce noise, water spray, or soap bubbles upon striking a hard surface. However, the Hudson '250 patent is also different in structure from the present invention and does not disclose a hand catapulted rocket that provides a self launched second flight upon striking the ground.

Lastly, U.S. Des. Pat. No. D346,844 to D' Andrade, U.S. Des. Pat. No. D347,865 to Bertrand, and U.S. Des. Pat. No. D185,870 to Apostolescu disclose designs of toy rockets that may be of general interest and pertinent to the construction and design of the present invention. However, none of these patents disclose a hand-launched toy rocket having the design features or structure of the present invention.

While the above-described devices fulfill their respective, particular objectives and requirements, the aforementioned patents do not describe a safe and easy to use hand-launched toy rocket that can be hand catapulted into the air for an initial flight followed by a self-launched second flight upon striking the ground.

Therefore, a need exists for a new and improved hand-launched toy rocket, which is safe and easy to use that can be hand catapulted into the air for an initial flight followed by a self-launched second flight upon striking the ground. In this regard, the present invention substantially fulfills this need. In this respect, the hand-launched toy rocket according to the present invention substantially departs from the conventional concepts and designs of the prior art, and in doing so provides an apparatus primarily developed for the purpose of providing a safe and inexpensive toy that can provide many hours of fun and enjoyment for children.

SUMMARY OF THE INVENTION

In view of the foregoing disadvantages inherent in the known types of toy rockets now present in the prior art, the present invention provides an improved hand-launched toy rocket, and overcomes the above-mentioned disadvantages and drawbacks of the prior art. As such, the general purpose of the present invention, which will be described subsequently in greater detail, is to provide a new and improved hand-launched toy rocket and method of use that has all the advantages of the prior art mentioned heretofore and many novel features that result in a toy rocket which is not anticipated, rendered obvious, suggested, or even implied by the prior art, either alone or in any combination thereof.

To attain this, the present invention essentially comprises a cylindrical toy rocket that measures at least 8-inches long and 2½ inches in diameter. The rocket has a weighted rubber nose cone that is mounted on an inner slide tube that fits inside the rocket's main body tube in contact with a compression spring. Both the main body tube and the inner slide tube are fabricated from a lightweight tubular material. At least three guide fins are attached to the outside of the main body tube at the bottom (exhaust) end of the rocket. The rocket is launched by means of an attached tether and gripping handle. The hand-launched toy rocket is a new toy that can provide outdoor entertainment for boys and girls. There is no operational cost associated with the toy since it is manually-operated. The toy will provide exercise, imagination, and all-around fun for any player.

In use, the handle is gripped in the hand of the user and swung in a vertical circular motion starting in an upward direction. The rocket is then released such that it is catapulted upward into the sky along an initial flight path. When the rocket reaches its apex and starts a descent, the heavier nose cone will assume a downward position. Upon impact with the ground, the nose cone and inner sliding tube are forced into the main tube body of the rocket, thereby compressing and storing potential energy in the spring. The spring then releases this stored energy, catapulting the rocket back into the air along a secondary flight path. Depending on the height of the initial flight, the rocket could make additional self-launches beyond the secondary flight launch, with each launch reaching a lower apex.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new hand-launched toy rocket that provides in the apparatuses and methods of the prior art some of the advantages thereof, while simultaneously overcoming some of the disadvantages normally associated therewith.

It is another object of the present invention to provide a new and improved hand-launched toy rocket that may be easily and efficiently manufactured and marketed.

An even further object of the present invention is to provide a new and improved hand-launched toy rocket that has a low cost of manufacture with regard to both materials and labor, and which accordingly is then susceptible of low prices of sale to the consuming public, thereby making such toy rockets economically available to the buying public.

Lastly, it is an object of the present invention to provide a new, improved, safer method of playing with toy rockets by children.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
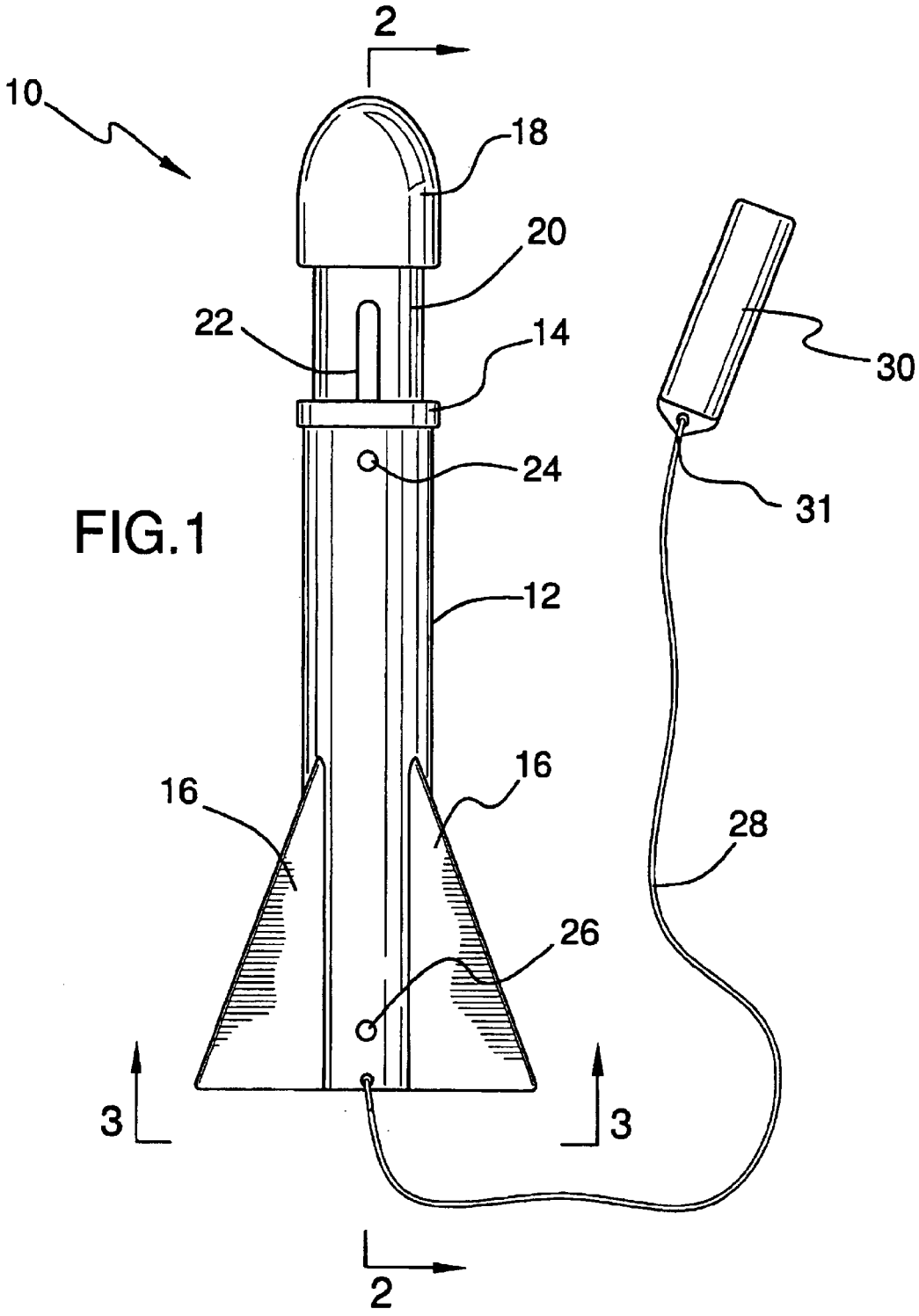
FIG. 1 is a perspective view of the preferred embodiment of the hand-launched toy rocket constructed in accordance with the principles of the present invention.
Figure 3:
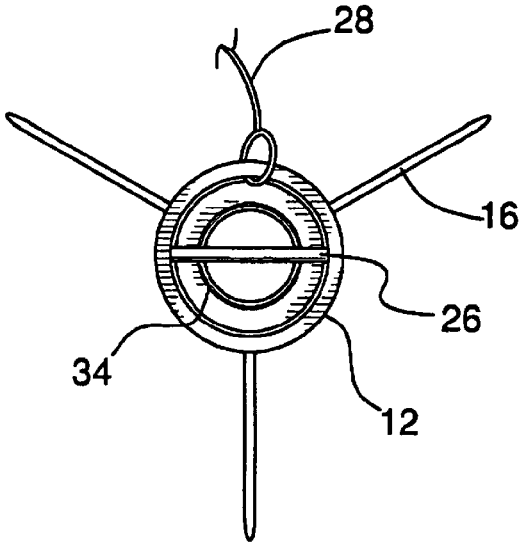
FIG. 3 is a bottom view of the hand-launched toy rocket of the present invention.
Figure 4:
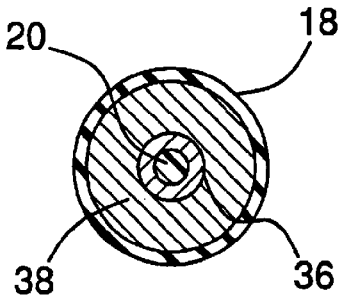
FIG. 4. is a cross-sectional bottom view of the nose cone of the hand-launched toy rocket of the present invention.

Referring now to the drawings, and particularly to FIGS. 1–5, a preferred embodiment of the hand-launched toy rocket of the present invention is shown and generally designated by the reference numeral 10.

In FIGS. 1–4, the new and improved hand-launched toy rocket 10 of the present invention, which is safe and easy to use and can be hand-catapulted into the air for an initial flight followed by a self-launched second flight upon striking the ground, is illustrated and will be described. The hand-launched toy rocket 10 has a main cylindrical body tube 12 with support ring 14 built-into the top end 27 opening and at least three guide fins 16 attached by mounting means, such as one of the well known methods used in modeling including glue, epoxy, or solder, to the outer cylindrical surface at the bottom end 29 of the main cylindrical body tube 12 and equally spaced around the circumference of the tube. In the event the main cylindrical body tube 12 is fabricated from molded plastic the guide fins 16 would likely be molded into the body tube. A molded rubber nose cone 18 with embedded weight 36 is attached by adapter ring 38 means to an inner slide tube 20, which slides inside the outer main body tube 12. The embedded weight 36 can be fabricated from material such as steel, brass, and fishing sinker type lead that is embedded inside the molded rubber nose cone. The inner slide tube 20 has closed-end aligning guide pin slots 22 cut on each sides of the thin-walled inner slide tube 20, which extend over most of the length of the tube. In addition, the inner slide tube 20 has a solid compression spring interface plate 32 mounted over the bottom opening of the tube. The main body tube 12 and inner sliding tube 20 are fabricated out of light-weight material such as molded plastic foam rubber strong cardboard tubing, PVC tubing, and thin aluminum tubing.

Figure 2:
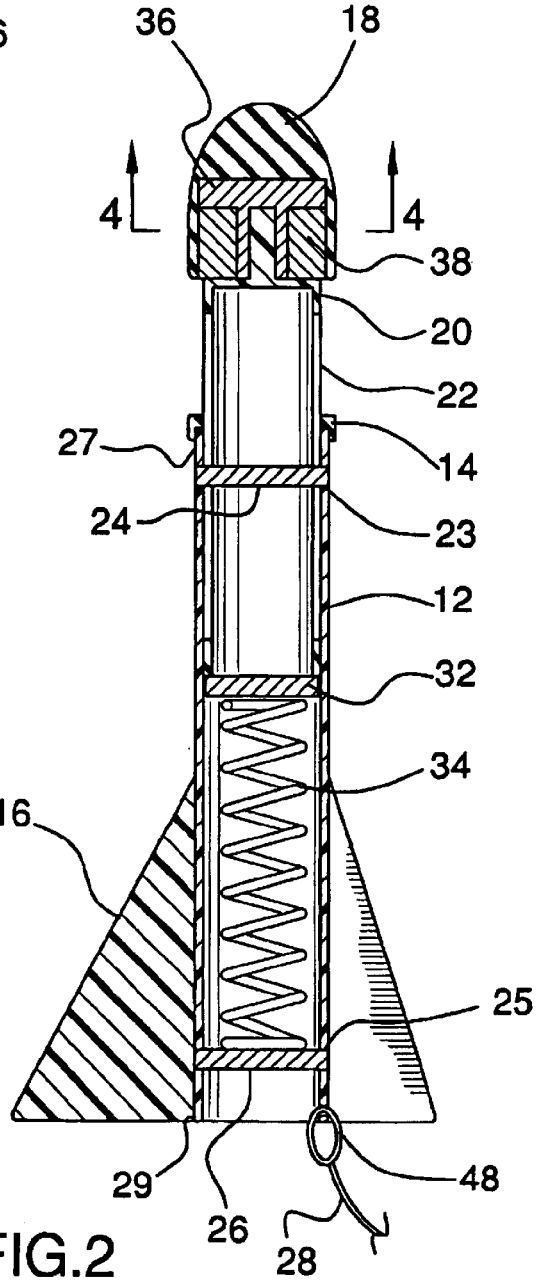
FIG. 2 is a cross-sectional side view of the hand-launched toy rocket of the present invention showing the internal workings of the rocket.

More particularly, FIG. 2 is a cross-sectional side view that shows the assembly and integral workings of the rocket. A spring support pin 26 is press fitted into support pin holes 25 near the bottom of the main body tube 12 and a compression spring 34 is inserted from the top of the main body tube so as to rest on the spring support pin 26. The press fit means of installing the spring support pin 26 into the support pin holes 25 near the bottom end 29 of the main cylindrical body tube 12 could involve the well known practice of driving a slightly oversized pin into the support pin holes 25 using a standard pin punch. The nose cone assembly, comprised of the inner slide tube 20 with an attached nose cone 18 at the top end and a solid compression spring interface plate 32 attached at the bottom end, is then placed inside the main body tube 12 with the spring interface plate 32 resting on the top of the compression spring 34. The nose cone is then rotated so as to align the guide pin slots 22 with additional guide pin holes 23 near the top of the main body tube 12 and a solid inner tube guide pin 24 is pressed into the guide pin holes 23, thereby containing the nose cone assembly inside the rocket's main body tube in such a way as to allow the nose cone assembly to move up and down inside the main body tube. Finally, a tether 28, such as a rope or nylon cord, with a handle 30 attached at the outer end 31 is connected by tether ring 48 means to the bottom of the rocket for use in hand launching the rocket. The length of the tether 28 is adjusted to accommodate the height of the person launching the rocket. Optionally, the tether can be made to be self-releasing from the rocket during launch. A quick release mechanism means, such as leaving a gap in the tether ring 48 so it can fall off the rocket once the centrifugal force applied in launching the rocket is absent, could be used.

Figure 5:
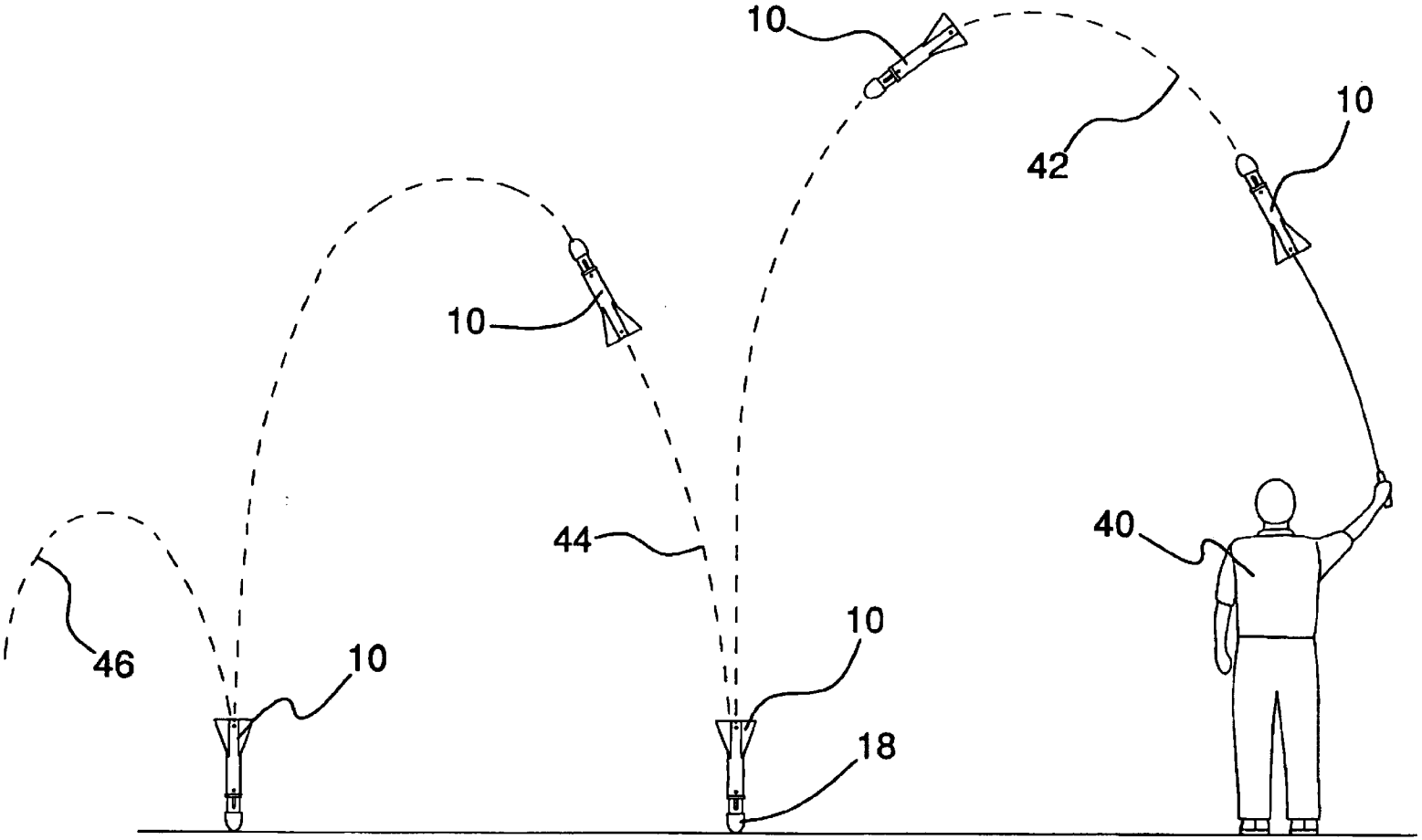
FIG. 5 is an application drawing illustrating a method of using the hand-launched toy rocket of the present invention.

FIG. 5 is an application drawing illustrating the method of using the hand-launched toy rocket of the present invention. In use, it can now be understood that the player (user) 40 grasps the tether handle 30 in his/her hand and swings it in a vertical circular motion starting in an upward direction. The rocket 10 is then released such that it is catapulted upward into the sky along an initial flight path 42. When the rocket reaches its apex and starts a descent, the heavier nose cone will assume a downward position. Upon impact with the ground, the nose cone 18 and inner sliding tube 20 are forced into main tube body of the rocket, thereby compressing and storing potential energy in the spring 34. The spring then releases this stored energy, catapulting the rocket back into the air along a secondary flight path 44. Depending on the height of the initial flight, the rocket could make additional self-flight launches 46, beyond the secondary flight launch, with each launch reaching a lower apex.

While a preferred embodiment of the hand-launched toy rocket has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, various suitable sturdy material such as thin-walled metal tubing, molded plastic, cardboard tubing, or a variety of other materials may be used to fabricate the rocket body. The rocket can be made in various sizes, but should be at least 8-in length to allow an adequate spring compression distance in order to properly self-launch the rocket. The rocket can be painted and decorated in various colors and designs to make it more attractive to children.

Therefore, the foregoing is considered as illustrative only of the principles of the invention. Further, since numerous modifications and changes will readily occur to those skilled in the art, it is not desired to limit the invention to the exact construction and operation shown and described, ad accordingly, all suitable modifications and equivalents may be resorted to, falling within the scope of the invention.

What is claimed is:

1. A hand-launched toy rocket, comprising:

a cylindrical main body tube, said main body tube being open at both the top end and the bottom end, said main body tube having a body tube support ring attached at the top end of said main body tube;

at least three rocket guide fins firmly attached by mounting means to the outer cylindrical surface at the bottom end of said main body tube, said guide fins being equally spaced around the perimeter of said main body tube;

a spring support pin firmly attached in through-holes located near the bottom end of said main body tube, said spring support pin being installed by press fit means;

a compression spring inserted from the top end of said main body tube, said compression spring being supported at the bottom end of said main body tube by said spring support pin;

a cylindrical inner slide tube, a solid compression spring interface plate firmly attached to the bottom end of said inner slide tube, said inner slide tube being slidably mounted inside said main body tube from said top end allowing said spring interface plate to rest on top of said compression spring, said inner slide tube further having closed-end aligning guide pin slots cut on each side of said inner slide tube and extending most of the height of said inner slide tube;

a solid inner tube guide pin firmly attached in through-holes located near the top end of said main body tube through said aligning guide pin slots in said inner slide tube, said inner tube guide pin being installed by press fit means;

a solid material nose cone attached to the top of said inner slide tube by means of an adapter ring, said nose cone having a weight embedded in said solid material;

a tether ring mounted to the bottom end of said main body tube;

a launching tether tied to said tether ring for hand-launching said rocket; and a launching handle attached to the outer end of said tether, whereby said rocket is hand-launched into the air along an initial flight path, landing on said nose cone to force said inner sliding tube against said compression spring, thereby storing potential energy in said compression spring, said potential energy being sequentially released by said compression spring to self-launch said rocket along a second flight path.

2. The apparatus of claim 1, wherein said nose cone is molded from a hard rubber type material so as to absorb the impact forces when said nose cone strikes the ground.

3. The apparatus of claim 1, wherein said weight embedded in said nose cone is fabricated of material from the group consisting of:

steel, brass, and fishing sinker type lead.

4. The apparatus of claim 1, wherein a quick release mechanism means is used to drop said tether from said rocket during launch.

5. The apparatus of claim 1, wherein said main body tube and inner sliding tube are fabricated with light-weight material from the group consisting of: molded plastic, foam rubber, strong cardboard tubing, PVC tubing, and thin aluminum tubing.

6. The apparatus of claim 1, wherein said tether is supplied from materials from the group consisting of: rope and nylon cord.

7. The apparatus of claim 6, wherein said tether is adjustable in length to accommodate the height of the person launching said rocket.

8. The apparatus of claim 1, wherein the length of said rocket is at least 8-inches, thereby providing adequate spring compression distance to produce adequate stored potential energy to properly self-launch said rocket.

9. A method for quickly and safely hand-launching a toy rocket, comprising the steps of:

providing a hand-launched toy rocket, said toy rocket comprised of:

a cylindrical main body tube, said main body tube being open at both the top end and the bottom end, said main body tube having a body tube support ring attached at the top end of said main body tube;

at least three rocket guide fins firmly attached by mounting means to the outer cylindrical surface at the bottom end of said main body tube, said guide fins being equally spaced around the perimeter of said main body tube;

a spring support pin firmly attached in through-holes located near the bottom end of said main body tube, said spring support pin being installed by press fit means;

a compression spring inserted from the top end of said main body tube, said compression spring being supported at the bottom end of said main body tube by said spring support pin;

a cylindrical inner slide tube, a solid compression spring interface plate firmly attached to the bottom end of said inner slide tube, said inner slide tube being slidably mounted inside said main body tube from said top end allowing said spring interface plate to rest on top of said compression spring, said inner slide tube further having closed-end aligning guide pin slots cut on each side of said inner slide tube and extending most of the height of said inner slide tube;

a solid inner tube guide pin firmly attached in through-holes located near the top end of said main body tube through said aligning guide pin slots in said inner slide tube, said inner tube guide pin being installed by press fit means;

a solid material nose cone attached to the top of said inner slide tube by means of an adapter ring, said nose cone having a weight embedded in said solid material;

a tether ring mounted to the bottom end of said main body tube;

a launching tether tied to said tether ring for hand-launching said rocket; and a launching handle attached to the outer end of said tether, whereby said rocket is hand-launched into the air along an initial flight path;

holding said launching handle in hand of the player;

swinging said rocket at end of said tether in a vertical circular motion starting in an upward direction;

releasing said rocket so as to catapult it upward into the sky along an initial flight path;

observing said rocket reach its apex and start a descent with the heavier nose cone in a downward position;

said rocket striking the ground so as at impact to force said nose cone and inner sliding tube into said main tube body, thereby compressing said compression spring storing potential energy in said spring;

releasing said potential energy stored in said compression spring; and sequentially self-launching said rocket along a second flight path.

10. The method of claim 9, wherein said nose cone is molded from a hard rubber type material so as to absorb the impact forces when said nose cone strikes the ground.

11. The method of claim 9, wherein said weight embedded in said nose cone is fabricated of material from the group consisting of:

steel, brass, and fishing sinker type lead.

12. The method of claim 9, wherein a quick release mechanism means is used to drop said tether from said rocket during launch.

13. The method of claim 9, wherein said main body tube and inner sliding tube are fabricated with light-weight material from the group consisting of: molded plastic, foam rubber, strong cardboard tubing, PVC tubing, and thin aluminum tubing.

14. The method of claim 9, wherein said tether is supplied from materials from the group consisting of: rope and nylon cord.

15. The method of claim 14, wherein said tether is adjustable in length to accommodate the height of the person launching said rocket.

16. The method of claim 9, wherein the length of said rocket is at least 8-inches, thereby providing adequate spring compression distance to produce adequate stored potential energy to properly self-launch said rocket.

17. A hand-launched toy rocket, comprising:

a cylindrical main body tube, said main body tube being open at both the top end and the bottom end, said main body being fabricated from a light-weight tubular material, said main body tube having a body tube support ring attached at the top end of said main body tube;

at least three rocket guide fins firmly attached by mounting means to the outer cylindrical surface at the bottom end of said main body tube, said guide fins being equally spaced around the perimeter of said main body tube;

a spring support pin firmly attached in through-holes located near the bottom end of said main body tube, said spring support pin being installed by press fit means;

a compression spring inserted from the top end of said main body tube, said compression spring being supported at the bottom end of said main body tube by said spring support pin;

a cylindrical inner slide tube, a solid compression spring interface plate firmly attached to the bottom end of said inner slide tube, said inner slide tube being slidably mounted inside said main body tube from said top end allowing said spring interface plate to rest on top of said compression spring, said inner slide tube being fabricated from a light-weight tubular material, said inner slide tube further having closed-end aligning guide pin slots cut on each side of said inner slide tube and extending most of the height of said inner slide tube;

a solid inner tube guide pin firmly attached in through-holes located near the top end of said main body tube through said aligning guide pin slots in said inner slide tube, said inner tube guide pin being installed by press fit means;

a molded hard rubber nose cone attached to the top of said inner slide tube by means of an adapter ring, said nose cone having a weight embedded in said molded rubber nose cone, said weight fabricated of a high density metal, said nose cone absorbing the impact forces when said nose cone strikes the ground;

a tether ring mounted to the bottom end of said main body tube;

a launching tether tied to said tether ring for hand-launching said rocket, said tether being adjustable in length to accommodate the height of the player launching said rocket; and a launching handle attached to the outer end of said tether, whereby said rocket is hand-launched into the air along an initial flight path, landing on said nose cone to force said inner sliding tube against said compression spring, thereby storing potential energy in said compression spring, said potential energy being sequentially released by said compression spring to self-launch said rocket along a second flight path.

18. The apparatus of claim 17, wherein a quick release mechanism means is used to drop said tether from said rocket during launch.

19. The apparatus of claim 17, wherein said tether is supplied from materials from the group consisting of: rope and nylon cord.

20. The apparatus of claim 17, wherein the length of said rocket is at least 8-inches, thereby providing adequate spring compression distance to produce adequate potential energy to properly self-launch said rocket.

* * * * *